US007637449B1

(12) United States Patent
Leyshon et al.

(10) Patent No.: US 7,637,449 B1
(45) Date of Patent: Dec. 29, 2009

(54) PILL CRUSHER POUCH

(75) Inventors: Frank Leyshon, Cambridge, OH (US); Ronald Funk, Cambridge, OH (US)

(73) Assignee: Healthcare Logistics, Inc., Circleville, OH (US)

( * ) Notice: Subject to any disclaimer, the term of this patent is extended or adjusted under 35 U.S.C. 154(b) by 0 days.

(21) Appl. No.: 11/153,516

(22) Filed: Jun. 14, 2005

(51) Int. Cl.
*B02C 19/00* (2006.01)

(52) U.S. Cl. ..... 241/301; 241/DIG. 27

(58) Field of Classification Search ..... 241/168, 241/169, DIG. 27, 606, 242, 91, 92, 100, 241/301; 383/36, 67, 209, 107, 109, 121–124; 222/107, 92; 206/219, 363
See application file for complete search history.

(56) References Cited

U.S. PATENT DOCUMENTS

| | | | | | |
|---|---|---|---|---|---|
| 2,103,389 | A | * | 12/1937 | Salfisberg | 222/107 |
| 2,350,931 | A | * | 6/1944 | Salfisberg | 222/214 |
| 2,416,816 | A | | 3/1947 | Campagnano | 229/56 |
| 3,189,227 | A | * | 6/1965 | Hobbs et al. | 222/94 |
| 3,670,954 | A | | 6/1972 | Leventhal | 229/57 |
| 3,935,993 | A | | 2/1976 | Doyen et al. | 383/94 |
| 3,980,225 | A | * | 9/1976 | Kan | 383/104 |
| 5,059,036 | A | | 10/1991 | Richison et al. | 383/61.2 |
| D337,828 | S | | 7/1993 | Gordon | D24/220 |
| 5,380,093 | A | | 1/1995 | Goldman | 383/38 |
| 5,709,479 | A | * | 1/1998 | Bell | 383/209 |
| 5,862,944 | A | * | 1/1999 | Scherr | 221/63 |
| 5,863,001 | A | * | 1/1999 | Schulze | 241/30 |
| 5,915,637 | A | | 6/1999 | Parsons | 241/168 |
| 5,931,345 | A | * | 8/1999 | Lane et al. | 222/105 |
| 5,952,025 | A | | 9/1999 | Yannuzzi, Jr. | 426/107 |
| D433,148 | S | | 10/2000 | Dennis | D24/220 |
| 6,170,985 | B1 | | 1/2001 | Shabram, Jr. et al. | 383/100 |
| 6,342,258 | B1 | * | 1/2002 | Berings et al. | 426/79 |
| 6,375,037 | B1 | * | 4/2002 | Bell et al. | 222/1 |
| 6,637,683 | B1 | | 10/2003 | Wilbur | 241/101.2 |
| 6,637,685 | B1 | | 10/2003 | Kruger | 241/169.1 |
| D497,543 | S | | 10/2004 | Buckley | D9/707 |
| D502,267 | S | | 2/2005 | Leyshon et al. | D24/220 |
| 7,051,963 | B1 | | 5/2006 | Buckley | |
| D528,781 | S | * | 9/2006 | Leyshon et al. | D3/203.2 |
| 7,347,394 | B2 | | 3/2008 | Buckley | |

* cited by examiner

*Primary Examiner*—Faye Francis
(74) *Attorney, Agent, or Firm*—Standley Law Group LLP

(57) ABSTRACT

The present invention is a pouch for crushing a tablet or pill, that features a containment portion for containing a tablet or pill while being crushed into a powder without loss of the powder, the containment portion having a slanted bottom adapted to direct the powder toward a focal point along the bottom, and at least one perforation along a line intersecting the bottom above the focal point.

4 Claims, 2 Drawing Sheets

PILL CRUSHER POUCH

TECHNICAL FIELD OF THE INVENTION

The present invention relates generally to tablet and pill crushing pouches for tablet and pill crushing devices.

BACKGROUND OF THE INVENTION

The present invention is an improvement in pill crushing pouches of the prior art, including the pill crusher pouch described in U.S. Design Pat. No. D497,543; which is hereby incorporated herein by reference.

The present invention provides a pill crushing pouch that provides a smooth and quiet crushing action, when used with tablet crushing devices such as that described in U.S. Pat. No. 5,915,637 and co-pending application Ser. No. 11/153,517, hereby incorporated herein by reference, and others.

These other advantages include effective crushing of the tablet into small particle size, the ability to crush tablets of various size and shape, and the reduction of risk of cross contamination from different medications.

Once the pill or tablet is crushed, it is also desirable to be able to dispense the medication in powdered form accurately into a container without loss or contamination.

Accordingly, there remains a need for a pill crushing pouch that is effective and efficient in operation, and which offers all of the same advantages of prior art devices while providing advantages related to the ease and accuracy of dispensing of the resultant powdered medication.

SUMMARY OF THE INVENTION

The present invention includes pouch for crushing a tablet or pill, comprising a containment portion for containing a tablet or pill while being crushed into a powder without loss of the powder, the containment portion having a slanted bottom adapted to direct the powder toward a focal point along the bottom, and at least one perforation along a line intersecting the bottom above the focal point.

It is preferred that the bottom of the pouch is V-shaped, although it may also be simply slanted to one side. The V-shaped bottom directs the powder to a relatively central point along the bottom of the pouch while a bottom that is slanted toward one side may direct the powder toward a point at one side of the bottom.

It is also preferred that pouch include an additional portion disposed below the bottom of the containment portion.

The pouch may be made of any material appropriate to withstand the crushing forces necessary to pulverize tablets or pills, and typically will be made of a plastic material of a thickness greater than 4 mils and preferably 8 mils.

The perforation may extend either partially along a line intersecting the bottom above the focal point, while it is preferred that the perforation(s) extends along a line intersecting the bottom above the focal point and without extending though the bottom.

Most preferably the pouch comprises: (a) a containment portion for containing a tablet or pill while being crushed into a powder without loss of the powder, the containment portion having a V-shaped bottom adapted to direct the powder toward a focal point along the bottom, (b) a tab portion below the containment portion, and (c) a perforation along a line intersecting the bottom and above the focal point, the perforation facilitating both the separation of the tab portion from the containment portion, and the opening of the containment portion through the bottom.

The present invention also includes a method of crushing a tablet or pill and dispensing the resultant powder therefrom, the method comprising the steps:

(a) placing the tablet or pill in a pouch, the pouch having a slanted bottom adapted to direct the powder toward a focal point along the bottom, and a perforation along a line intersecting the bottom above the focal point; (b) crushing the tablet or pill in the pouch so as to form a powder; and (c) tearing the pouch along the line so as to open the pouch at the bottom; and (d) emptying the powder from the pouch through the bottom.

Other aspects and advantages of the present invention will become apparent from the following detailed description, taken in conjunction with the accompanying drawings, illustrating by way of example the principles of the invention.

DETAILED DESCRIPTION AND BEST MODE OF THE INVENTION

Figure 1:
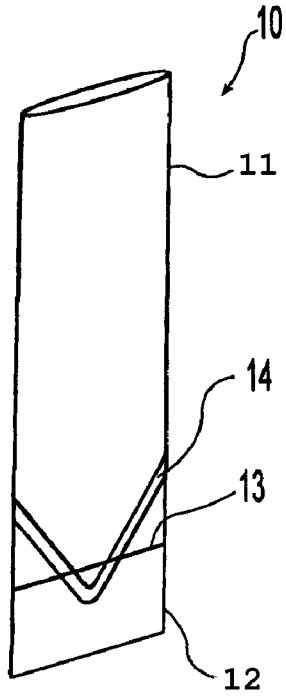
FIG. 1 is a side perspective view of a pill crusher pouch in accordance with one embodiment of the present invention.

In accordance with the foregoing summary of the invention, the following presents a description of the preferred embodiment of the present invention which is also considered to be the best mode thereof.

In the following detailed description and in the several figures of the drawings, like elements are identified with like reference numerals.

With reference now to the drawings, FIG. 1 is a side perspective view of a pill crusher pouch of the present invention.

Shown in FIG. 1 is a pill crusher pouch 10 that is constructed according to a preferred embodiment of the present invention. The pill crusher pouch 10 includes a bottom tab portion 12 and a top containment portion 11 which are separated by a separation line 13. The separation line 13 preferably includes a perforation that extends partly along the separation line 13 from one or both sides of the pouch, with the exception that it not extend completely across that part of the line that intersects the V-shaped bottom 14. Either design allows for the manual separation of the bottom tab portion 12 from the top containment portion 11.

The pill crusher pouch 10 may be made of any appropriately strong material to withstand the crushing forces required to crush or pulverize a pill or tablet contained in the pouch without bursting. The material is typically a thermoplastic material, as is known and used for these types of devices.

The overall length of the pouch should be of sufficient size to contain the resultant powder formed during the pill crushing action of a tablet crusher. Although not limited to any given size, and by way of example, in the preferred embodiment, the overall length of the pouch is about 3½ inches, with the separation line 13 located about ¾ inch from the bottom, and the width of the pouch being about 1½ inches.

A V-shaped bottom 14 is formed at the bottom of the top containment portion 12. The V-shaped bottom 14 is formed by heat-sealing the plastic material from which the pouch is made. In this regard, the pouch may be made from a tubular flexible thermoplastic material, that may be heat-sealed across its width to form the V-shaped bottom 14, and perforated as described herein. The heat seal forming the V-shaped bottom 14 preferably is of sufficient width to provide strength against bursting during the pill crushing action of a tablet crusher. Although not limited to any given size, and by way of example, the heat seal forming the V-shaped bottom typically is at least about ⅛ inch and most preferably at about ¼ inch.

The separation line 13 intersects the V-shaped bottom 14 such that the perforation(s) along the separation line 13 facilitate the opening of the bottom of the top containment portion 11.

Figure 2:
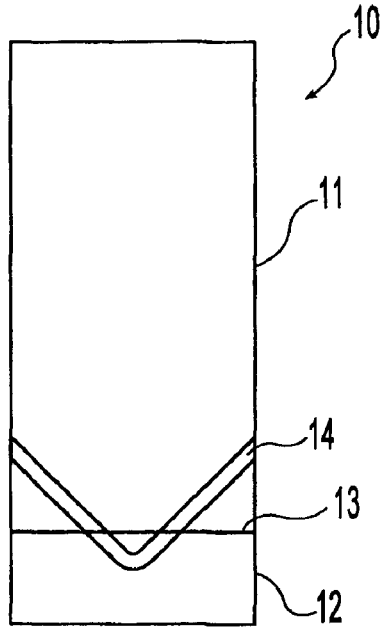
FIG. 2 is a front elevational view of the pill crusher pouch in accordance with one embodiment of the present invention.

FIG. 2 is a front elevational view of the pill crusher pouch 10 of the present invention wherein identical reference numbers refer to portions thereof.

Figure 3:
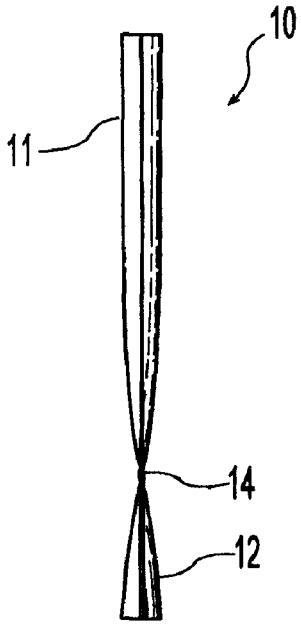
FIG. 3 is a side elevational view of the pill crusher pouch in accordance with one embodiment of the present invention.

FIG. 3 is a side elevational view of the pill crusher pouch 10 of the present invention wherein identical reference numbers refer to portions thereof.

Figure 4:
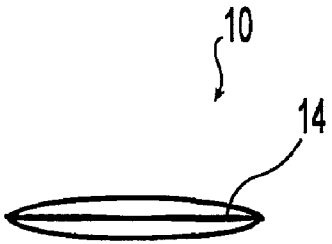
FIG. 4 is a top plan view of the pill crusher pouch in accordance with one embodiment of the present invention.

FIG. 4 is a top plan view of the pill crusher pouch 10 of the present invention wherein identical reference numbers refer to portions thereof.

Figure 5:
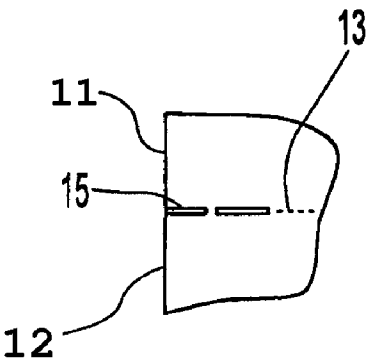
FIG. 5 is a detailed view of the pill crusher pouch in accordance with one embodiment of the present invention.

FIG. 5 is a detailed view of the side of the pill crusher pouch 10 at the position of the separation line 13. This Figure shows a perforation 15 extending along a part of the separation line 13, in accordance with one embodiment of the present invention. In another embodiment, the perforation may extend along the entire length of the separation line 13 with the exception that it not extend completely across that part of the line that intersects the V-shaped bottom 14, such that the top containment portion 11 remains closed during the crushing operation.

Figure 6:
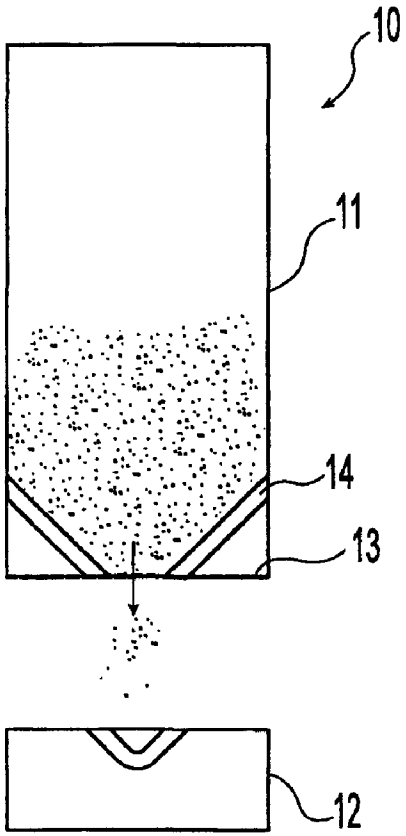
FIG. 6 is another side perspective view of a pill crusher pouch in accordance with one embodiment of the present invention.

In operation, one or more pills are placed in a pouch. The pouch containing the pill(s) can then be crushed therein by any means, preferably by inserting the pouch between a platen and anvil of a tablet and pill crushing device as are known and used in the art. Once the pill or tablet is crushed or pulverized, the resultant powder or particles are allowed to collect at the bottom of the pouch. The perforation that extends partly along the separation line 13 from one or both sides of the pouch facilitates the partial or complete separation of the bottom tab portion 4412 from the top containment portion 11, so as to open the V-shaped bottom 14 of the top containment portion 11. This may be done by the operator grasping the bottom tab portion 12 and the top containment portion 11, and applying a tearing action along the perforation, to open the pouch at its bottom while the bottom of the pouch is held over the intended target for the medication (such as a container). This permits the resultant powder or particles to be accurately dispensed into a container without contamination or loss, as the slanted bottom provides a funnel-like structure to guide the resultant powder or particles to the desired location, as shown in FIG. 6.

The advantages of the invention when compared to the prior art include the effective crushing of the tablet into small particle size, the ability to crush tablets of various size and shape, and the reduction of risk of cross contamination from different medications. Once the pill or tablet is crushed, the medication in powdered or particulate form may be dispensed from the pouch accurately, such as into a container, and without loss or contamination with relative ease.

It will be evident that there are additional embodiments and applications which are not disclosed in the detailed description but which clearly fall within the scope of the present invention. The specification is, therefore, intended not to be limiting, and the scope of the invention is to be limited only by the following claims. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All variations that come within the meaning and range of equivalency of the claims are to be embraced within their scope.

What is claimed is:

1. A pouch for crushing at least one medication pill or tablet and dispensing the resulting powder therefrom, comprising:

a flattened tube of a flexible thermoplastic material having an open first end and a second end;

a separation line that passes across the flattened tube from side to side, effectively dividing the tube into a top containment portion and a bottom tab portion, the separation line comprising perforations along at least a portion thereof to facilitate removing the bottom tab portion from the top containment portion; and a V-shaped heat seal comprising first and second heat seal lines imposed upon the tube, the heat seal lines originating at opposite sides of the tube in the top containment portion and intersecting at a point in the bottom tab portion.

2. The pouch of claim 1 wherein:

each end of the separation line is perforated.

3. The pouch of claim 1, wherein:

the top containment portion is sized and adapted for receiving the uncrushed medication and containing the resulting powder.

4. A pouch for containing a medication pill or tablet in a crushing device and dispensing the resulting powder therefrom, comprising:

a flattened tube of a flexible thermoplastic material having an open first end and a second end and first and second side edges;

a separation line that passes across the flattened tube from the first side to the second side, effectively dividing the flattened tube into a top containment portion and a bottom tab portion, the separation line comprising perforations along at least a portion thereof to facilitate removing the bottom tab portion from the top containment portion; and a V-shaped heat seal, with first and second heat seal lines that originate at the respective first and second side edges in the top containment portion and intersect at a point in the bottom tab portion, such that separation of the tube along the separation line provides a funnel shaped opening in the top containment portion for dispensing the powder.

* * * * *